US008550609B2

(12) United States Patent
Knierim et al.

(10) Patent No.: US 8,550,609 B2
(45) Date of Patent: Oct. 8, 2013

(54) SYSTEM AND METHOD FOR MEASURING A SUPPLY OF SOLID INK IN A SOLID INK PRINTER

(75) Inventors: David L. Knierim, Wilsonville, OR (US); Ernest Isreal Esplin, Sheridan, OR (US); Michael Alan Fairchild, Vancouver, WA (US)

(73) Assignee: Xerox Corporation, Norwalk, CT (US)

( * ) Notice: Subject to any disclaimer, the term of this patent is extended or adjusted under 35 U.S.C. 154(b) by 1381 days.

(21) Appl. No.: 11/986,505

(22) Filed: Nov. 21, 2007

(65) Prior Publication Data

US 2009/0128591 A1 May 21, 2009

(51) Int. Cl.
*B41J 2/175* (2006.01)

(52) U.S. Cl.
USPC ..... 347/88; 347/7; 347/85

(58) Field of Classification Search
USPC ..... 347/7, 88, 99, 19, 85
See application file for complete search history.

(56) References Cited

U.S. PATENT DOCUMENTS 4,800,755 A 1/1989 Fathauer et al.
5,005,409 A 4/1991 Hochstein
5,086,274 A 2/1992 Gobin et al.
5,433,115 A 7/1995 Spillman, Jr. et al.
5,440,300 A 8/1995 Spillman, Jr.
5,682,184 A * 10/1997 Stephany et al. ..... 347/7
6,086,179 A * 7/2000 Kishi ..... 347/7
6,318,826 B1 * 11/2001 Froger et al. ..... 347/7

FOREIGN PATENT DOCUMENTS

JP 62046650 * 2/1987

* cited by examiner

*Primary Examiner* — Lam S Nguyen
(74) *Attorney, Agent, or Firm* — Maginot, Moore & Beck, LLP

(57) ABSTRACT

A solid ink printer includes a solid ink measurement system that helps ensure an adequate supply of solid ink is in the feed channels delivering solid ink to a melting device within a printer. The solid ink measurement system includes a driving electrode mounted along a substantial length of a first structure of a first solid ink feed channel, a sensing electrode mounted along a substantial length of a second structure of the first solid ink feed channel, the sensing electrode being opposite and generally parallel to the driving electrode, an AC voltage source coupled to the driving electrode to generate an electrical field emitted from the driving electrode, and a capacitance measurement circuit coupled to the sensing electrode to receive an electrical signal induced in the sensing electrode by the electrical field generated by the driving electrode, the capacitance measurement circuit being configured to identify an amount of solid ink in the first feed channel that corresponds to the electrical signal received from the sensing electrode.

15 Claims, 5 Drawing Sheets

SYSTEM AND METHOD FOR MEASURING A SUPPLY OF SOLID INK IN A SOLID INK PRINTER

TECHNICAL FIELD

The solid ink measurement system disclosed below generally relates to solid ink printers, and, more particularly, to solid ink printers that have ink loaders with feed channels to guide solid ink sticks towards to a melting assembly.

BACKGROUND

Solid ink or phase change ink printers encompass various imaging devices, such as printers and multi-function platforms. Solid ink printers offer many advantages over other types of image generating devices, such as laser and aqueous inkjet approaches. These advantages include higher document throughput, sharp colors, and less packaging waste for the ink consumed by the printer.

A typical solid ink imaging device includes an ink loader, which receives solid ink units, such as ink sticks or pellets. These ink units remain solid at room temperatures so a user can conveniently store solid ink in proximity to a device and handle the solid ink during the loading phase without mess or staining. Coupled to the ink loader is a feed channel through which multiple units of the solid ink may be transported for delivery to a melting assembly. Thus, the ink is loaded by a user in solid form into the ink loader and then the solid ink is moved into the feed channel for delivery to the melting assembly. In most color solid ink imaging devices, an ink loader includes a plurality of feed channels, one for each color of ink used in the device. These multiple feed channels and melting assemblies are typically provided in parallel in the imaging device.

For example, FIG. 1 shows a previously known solid ink, or phase change, ink printer 10 that includes an outer housing having a top surface 12 and side surfaces 14. A user interface display, such as a front panel display screen 16, displays information concerning the status of the printer, and user instructions. Buttons 18 or other control elements for controlling operation of the printer are adjacent the user interface window, or may be at other locations on the printer. An ink jet printing mechanism (not shown) is contained inside the housing. An ink feed system delivers ink to the printing mechanism. The ink feed system is contained under the top surface of the printer housing. The top surface of the housing includes a hinged ink access cover 20 that opens as shown in FIG. 2 and FIG. 3, to provide the user access to the ink feed system.

In the particular printer shown, the ink access cover 20 is attached to an ink load linkage element 22 so that when the printer ink access cover 20 is raised, the ink load linkage 22 slides and pivots to an ink load position. As seen in FIG. 2, opening the ink access cover reveals a key plate 26 having keyed openings 24A-D. Each keyed opening 24A, 24B, 24C, 24D provides access to an insertion end of one of several individual feed channels 28A, 28B, 28C, 28D of the solid ink feed system (see FIG. 2).

Each longitudinal feed channel 28A-D delivers ink sticks 30 of one particular color to a corresponding melt plate 32. Each feed channel has a longitudinal feed direction from the insertion end of the feed channel to the melt end of the feed channel. A melt plate 32 is located at the melt end of the feed channel. The solid ink stick is changed into a liquid form by the melt plate 32 and the melted ink is provided through gap 33 to a liquid ink reservoir (not shown). The feed channels 28A-D have a longitudinal dimension from the insertion end to the melt end, and a lateral dimension, substantially perpendicular to the longitudinal dimension. Each feed channel in the particular embodiment illustrated includes a push block 34 driven by a driving force or element, such as a constant force spring 36, to push the individual ink sticks along the length of the longitudinal feed channel toward the melt plates 32 that are at the melt end of each feed channel. The tension of the constant force spring 36 drives the push block toward the melt end of the feed channel. The ink load linkage 22 is coupled to a yoke 38, which is attached to the constant force spring 36 mounted in the push block 34. The attachment to the ink load linkage 22 pulls the push block 34 toward the insertion end of the feed channel when the ink access cover is raised to reveal the key plate 26.

A color printer typically uses four colors of ink (yellow, cyan, magenta, and black). In the four color ink printer shown in FIG. 2, each feed channel receives ink sticks 30 of a single color. The operator of the printer exercises care to avoid inserting ink sticks of one color into a feed channel for a different color. The key plate 26 has keyed openings 24A, 24B, 240, 24D to aid the printer user in ensuring that only ink sticks of the proper color are inserted into each feed channel. Each keyed opening 24A, 24B, 240, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

In another loading system for a solid ink printer, a mechanized drive provides solid ink to a melting assembly. As shown in FIG. 4, a curved feed channel 114 includes an endless belt 118 mounted around pulleys 120 at least some of which are driven by a motor and gear train 122 or the like. An ink stick 126 placed in the port 124 engages the belt 118 and is carried along the feed channel 114 in response to the pulleys 120 being driven. After transitioning through the curve 128, the ink stick begins a fall towards a melting assembly 130.

In order to sense the presence of ink sticks in the vertical section of the feed channel 114, one or more mechanical flags may be provided. As shown in FIG. 4, a low ink flag 136 is positioned near the end of the transition section and an out of ink flag 140 is positioned near the melting assembly. The mechanical flag may be a finger that is biased to move into the ink stick path. An ink stick moving through the feed channel 114, however, urges the flag against the biasing action to displace the flag from its path as it passes a flag. The presence of the flag may be electrically sensed to generate a signal that indicates whether an ink stick is acting on a flag or not. For example, if the low ink flag indicates no ink stick is acting on it to move it out of the ink stick path, then a signal is generated that indicates only a number of ink sticks corresponding to the length of feed channel below the low flag to the melting assembly may be present in the feed channel. Similarly, if no ink stick is acting on the out flag, then an insufficient amount of ink stick is in the vertical portion of the feed channel to provide a reliable supply of solid ink to the melting assembly for use in the printer. In response to the signal generated from the low flag or out flag indicating no ink stick is opposite the flag, a controller in the printer may activate the motive force to the pulleys 120 to transport ink sticks to the vertical section of the feed channel to replenish the stack of ink sticks against the melting assembly.

In some previously known solid ink printers that use biased flags to indicate low solid ink conditions, the controller coupled to the flags would generate a refill signal to an operator in response to one flag transitioning to the low or out condition that indicated the operator should refill all of the feed channels even though only one channel had reached the low or out condition. In other previously known solid ink printers, the controller generates a signal to refill only the channel or channels that are experiencing the low or out condition that caused the flag to transition. While this method of operation helps eliminate attempts to reload a channel that does not require refilling, it does not provide an accurate measurement of the amount of solid ink within a feed channel. Instead, this type of feed channel status system only indicates whether the feed channel is almost out of or is out of solid ink. Consequently, a solid ink stick loader system that provides an indication of the amount of solid ink in each feed channel is desirable.

SUMMARY

A solid ink printer includes a solid ink measurement system that indicates the amount of solid ink in the feed channels of an ink loader. The solid ink measurement system includes a driving electrode mounted along a substantial length of a first structure of a first solid ink feed channel, a sensing electrode mounted along a substantial length of a second structure of the first solid ink feed channel, the sensing electrode being opposite and generally parallel to the driving electrode, an alternating current (AC) voltage source coupled to the driving electrode to generate an electrical field emitted from the driving electrode, and a capacitance measurement circuit coupled to the sensing electrode to receive an electrical signal induced in the sensing electrode by the electrical field generated by the driving electrode, the capacitance measurement circuit being configured to identify an amount of solid ink in the first feed channel that corresponds to the electrical signal received from the sensing electrode.

The ink loader having the described structure may be used to implement a method for measuring a supply of solid ink in the ink loader. The method includes coupling an AC voltage source to a driving electrode mounted along a substantial length of a first structure of a first solid ink feed channel to emit an electric field from the driving electrode into the first solid ink feed channel, generating an electrical signal in a first sensing electrode mounted along a substantial length of a second structure of the first solid ink feed channel that is opposite and generally parallel to the driving electrode, the electrical signal being generated in response to the electric field generated by the driving electrode, and identifying an amount of solid ink in the first feed channel that corresponds to the electrical signal generated by the first sensing electrode.

BRIEF DESCRIPTION OF THE DRAWINGS

Features for measuring the amount of solid ink in the feed channels of a solid ink loader are discussed with reference to the drawings, in which.

DETAILED DESCRIPTION

The term "printer" refers, for example, to reproduction devices in general, such as printers, facsimile machines, copiers, and related multi-function products. While the specification focuses on a system that transports solid ink through a solid ink printer, the transport system may be used with any solid ink image generating device.

Figure 5:
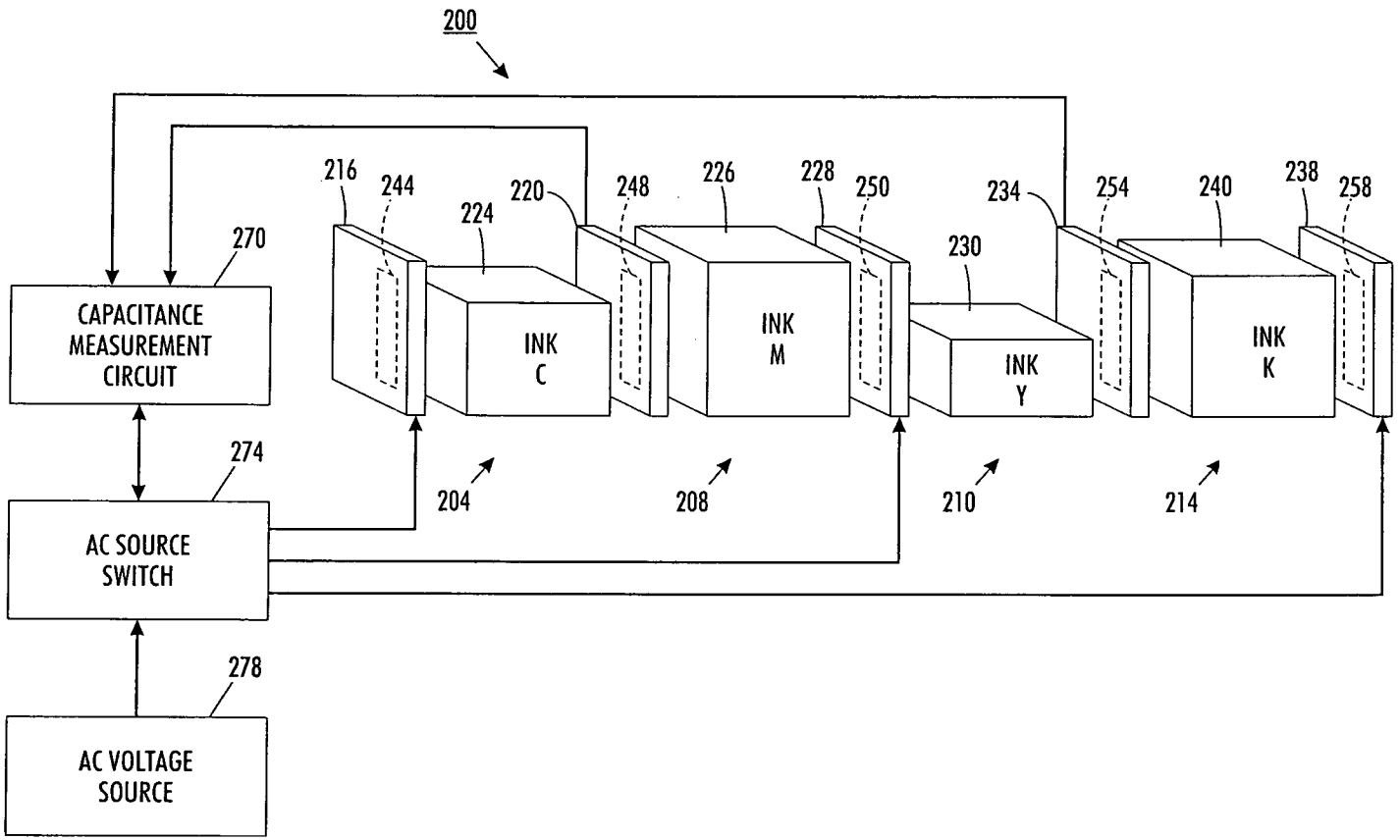
FIG. 5 is a diagram of a system for measuring the amount of solid ink in an ink loader having four feed channels.

A solid ink stick measuring system 200 is shown in FIG. 5. The system includes feed channels 204, 208, 210, and 214. The feed channels are formed by walls 216, 220, 228, 234, and 238. Mounted within these walls are electrodes 244, 248, 250, 254, and 258. The electrodes 244, 250, and 258 are coupled to an AC voltage source 278 through an AC source switch 274. The electrodes 248 and 254 are coupled to the capacitance measurement circuit 270. The ink sticks 224, 226, 230, and 240 represent different colors of solid ink and different amounts of solid ink in the feed channels. The electrodes coupled to the AC voltage source 278 are denoted as driving electrodes in the discussion below and the electrodes coupled to the capacitance measurement circuit are denoted as sensing electrodes. In brief, an electrical field is emitted by a driving electrode that is located on or within a wall of a feed channel that is opposite a sensing electrode. The electric field induces an electrical signal in the sensing electrode and the electrical signal is delivered to the capacitance measurement circuit. Because the electrical signal induced in a sensing electrode varies with the dielectric of the materials in the feed channel, the capacitance measured by the capacitance measurement circuit from the electrical signal received from a sensing electrode may be used to identify the amount of solid ink in a feed channel.

Figure 1:
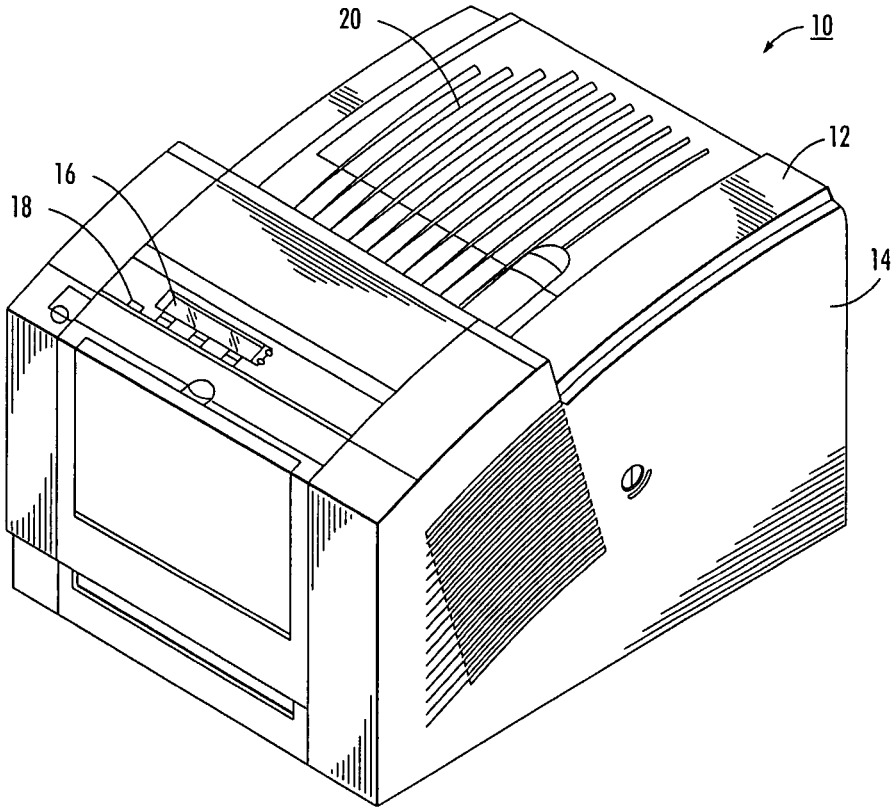
FIG. 1 PRIOR ART
FIG. 1 is a perspective view of a desktop solid ink printer having an ink loader with feed channels.
Figure 2:
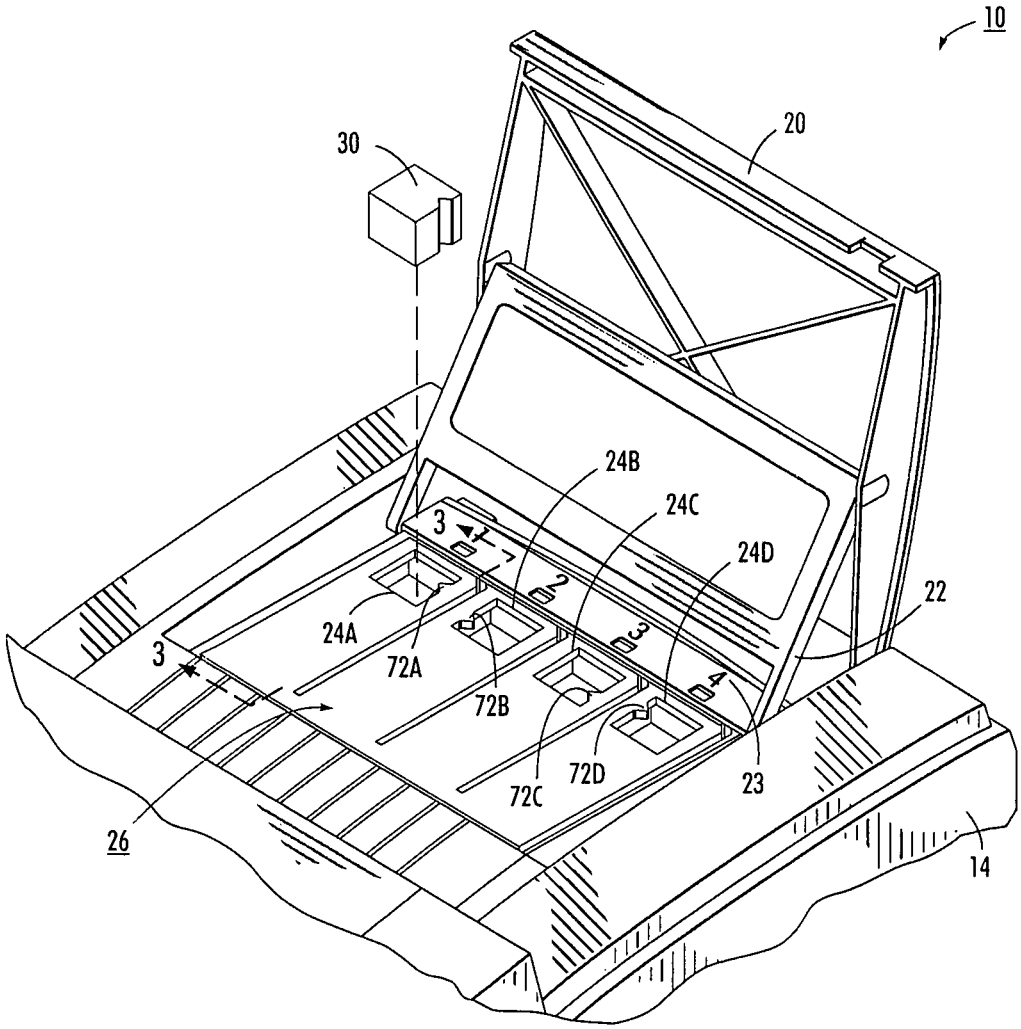
FIG. 2 PRIOR ART
FIG. 2 is a perspective view of the ink loader and the insertion ports for the feed channels.
Figure 3:
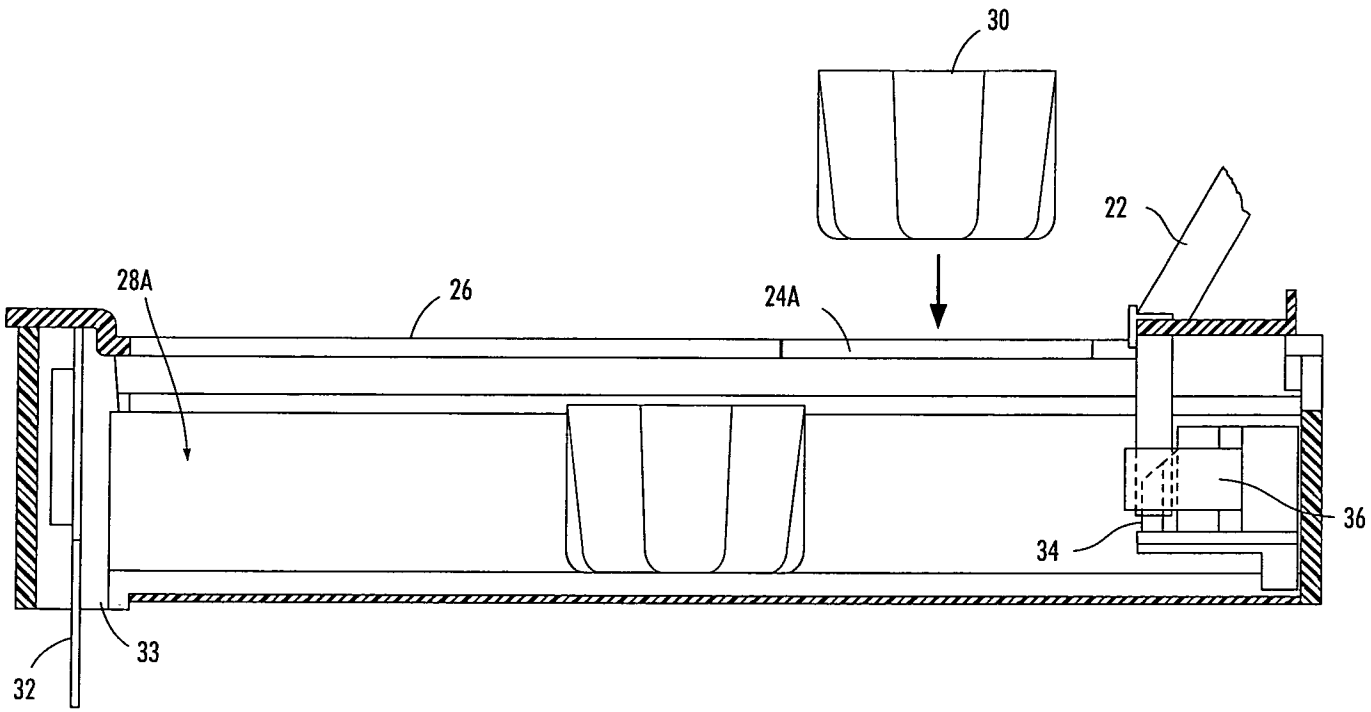
FIG. 3 PRIOR ART
FIG. 3 is a cross-sectional view of one of the feed channels shown in FIG. 2.
Figure 4:
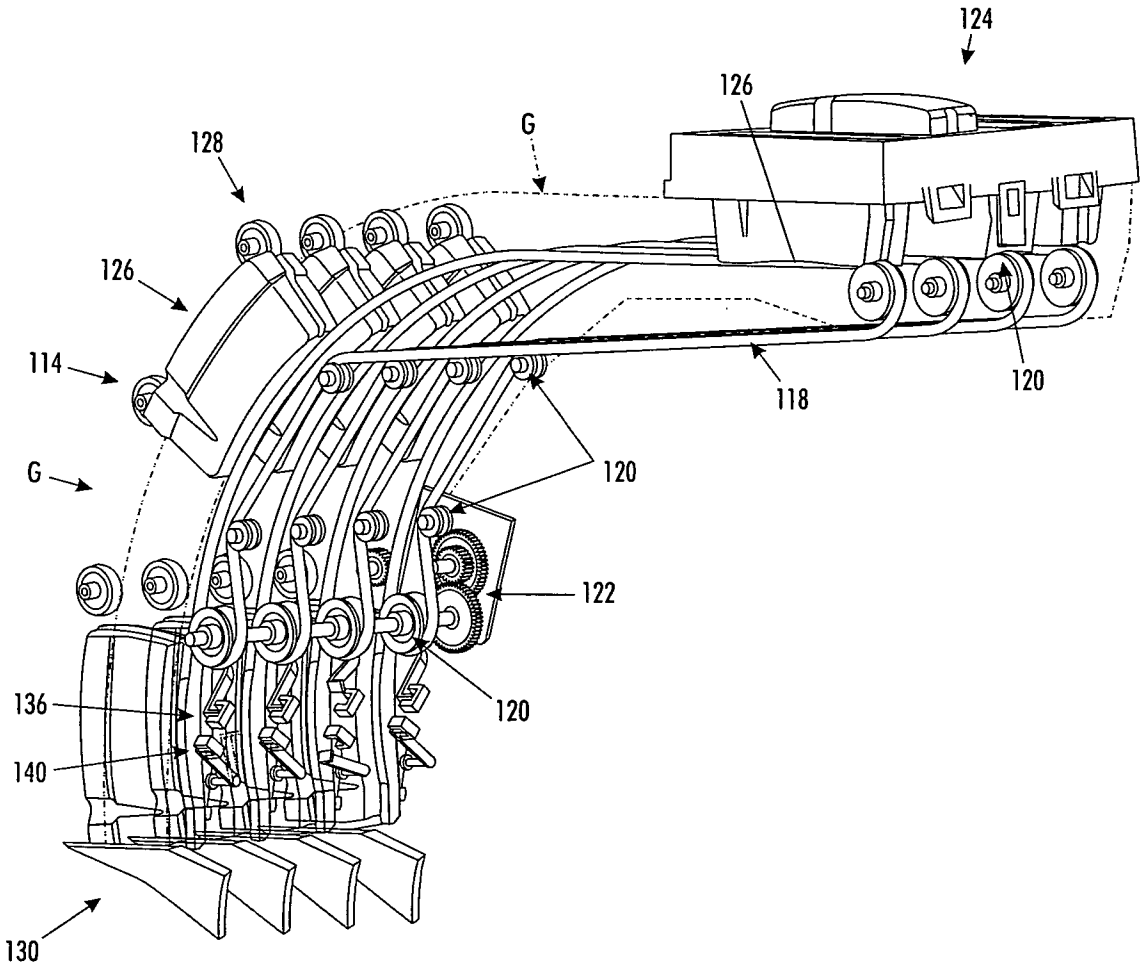
FIG. 4 PRIOR ART
FIG. 4 is a perspective view of feed channels in an ink loader for a larger solid ink printer having flags to indicate a low or exhausted solid ink supply.

In more detail, the feed channels 204, 208, 210, and 214 are formed by electrical insulating material. Although the feed channels in FIG. 5 are shown as vertically oriented channels, other orientations may be used. Additionally, the feed channels of FIG. 5 are shown without a back or front covering surface, such as the floor and cover of the ink loader described above with reference to FIG. 2. The representation of FIG. 5 is provided to simplify the discussion of the solid ink measuring system.

Longitudinally mounted along the walls of the feed channels are the electrodes 244, 248, 250, 254, and 258. These electrodes may be formed within a feed channel wall or inset within a wall so the electrodes are exposed to the feed channel space between the walls. The electrodes may be cylindrical electrical conductors, such as wires, or they may be planar strip conductors, such as sheets of conductive material. Additionally, the electrodes may be grids of electrically conductive material.

The driving electrodes 244, 250, and 258 are coupled to the AC voltage source 278 through an AC source switch 274. The AC voltage source is an alternating current (AC) voltage source in one embodiment, although the AC source 278 may also produce a DC component, such as a voltage that toggles between 0 and some positive voltage. The AC component of the signal drives the electrodes for the capacitance measurement, but the overall voltage may be the sum of a DC voltage and an AC voltage. The AC source switch 274 may be operated to couple the AC voltage source 278 to the driving electrodes 244 and 258 or to the driving electrode 250. That is, the coupling of the AC voltage source 278 to the various driving electrodes may be mutually exclusive so that different driving electrodes emit an electric field at different times. This selective coupling of the AC voltage source 278 to the driving electrodes enables a single sensing electrode to be used to measure the amount of solid ink in two different feed channels.

For example, coupling driving electrodes 244 and 258 to the AC voltage source 278 causes these electrodes to emit electric fields that induce signals in sensing electrodes 248 and 254, respectively. These signals may be used to identify the amount of solid ink in feed channels 204 and 214, respectively. After the driving electrodes 244 and 258 are de-coupled from the AC voltage source 278 by the AC source switch 274, the AC source switch may be operated to couple the driving electrode 250 to the AC voltage source. The electric field emitted by the driving electrode 250 in response to the current flow in the electrode induces an electrical signal in sensing electrodes 248 and 254. These signals may be used to identify the amount of solid ink in feed channels 208 and 210, respectively. Thus, the sensing electrode 248 may be used to measure the solid ink in feed channels 204 and 208 while the sensing electrode 254 may be used to measure the solid ink in channels 208 and 210. While the embodiment shown in FIG. 5 uses an alternating arrangement of sensing electrodes and driving electrodes to use the sensing electrodes more efficiently, other arrangements are possible. For example, each feed channel in an ink loader may be provided with a sensing electrode and a driving electrode. Also, while the electrodes are shown as being incorporated in the side walls of a feed channel, they may also be incorporated in a floor and cover over the feed channels.

As noted above, the electrical signals induced in the sensing electrodes depend upon the dielectric constant of the materials in the feed channel between the driving electrode and the sensing electrode. Because the dielectric constant of air is notably different from the dielectric constant of solid ink, the electrical signal induced in a sensing electrode corresponds to the amount of solid ink interposed between a driving electrode and a sensing electrode. These signals are provided to a capacitance measurement circuit 270 for identification of the amount of solid ink in a feed channel.

The capacitance measurement circuit 270 may be implemented with an application specific integrated circuit (ASIC) with associated interface circuitry. Alternatively, the circuit 270 may be implemented with a general purpose microprocessor that includes analog-to-digital converters and that executes instructions stored in memory coupled to the processor. The general purpose processor may be one of the controllers distributed in a solid ink printer, such as a print head controller or the overall printer controller. In yet another embodiment, the circuit 200 may be implemented with discrete hardware components.

The capacitance measurement circuit 270, regardless of the particular implementation, is configured to receive the electrical signals induced in the sensing electrodes and identify the amount of solid ink in the corresponding feed channel from the electrical signal. This identification may be obtained from a look up table using current or voltage levels over an expected range as indices with solid ink amounts stored in association with those indices. The solid ink amount may be identified with reference to an equation: $A=(I_e \times F)-C_{offset}$, where A is the amount of solid ink in the channel, $I_e$ is the current sensed in the electrode, F is a scaling factor, and $C_{offset}$ is an empty channel offset value. The scale factor and offset value may be determined empirically. These data may represent a mean value for a plurality of scale factors or currents measured for empty channels or they may be measured for a particular device during manufacture and then stored in the memory of the device. The scale factor and offset value may be measured for each channel in the printing device and stored in the device. The AC current received from the electrode may be converted by an A/D converter to a digital value that is read and processed by the capacitance measurement circuit 270.

The solid ink amounts identified by the capacitance measurement circuit may be expressed as units of mass or as a percentage of feed channel capacity. The solid ink amounts for the feed channels may be displayed to an operator for evaluation as to whether solid ink should be added to one or more feed channels. Additionally, the capacitance measurement circuit may be configured to control the AC source switch to couple the AC source to the driving electrodes in a predetermined sequence for inducing electrical signals in the sensing electrodes. In this manner, the circuit 200 is able to determine which driving electrodes are inducing signals in the sensing electrodes so the identified solid ink amounts are associated with the corresponding feed channel.

In operation, opposing electrodes are installed in feed channels of an ink loader and a capacitance measurement circuit, AC source switch, and AC voltage source are configured within the solid ink printer. In response to the printer being activated, the measurement circuit periodically operates the AC source switch to couple the driving electrodes to the AC voltage source and selectively activate the driving electrodes to emit electric fields. The electric fields pass through the feed channel and induce electrical signals in the sensing electrodes. These signals are provided to the capacitance measurement circuit for identification of the solid ink amounts in the feed channels. These measured amounts may be displayed for operator evaluation and action.

Those skilled in the art will recognize that numerous modifications can be made to the specific implementations described above. For example, other arrangements of electrodes may be used to obtain a signal related to the electrical capacitance of the feed channel space between driving electrodes and sensing electrodes. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from the patentees and others.

The invention claimed is:

1. A solid ink measurement system comprising:

a first solid ink feed channel having a keyed opening at a first end of the first solid ink feed channel, a melt plate at a second end of the first solid ink feed channel, a first inner wall, and a second inner wall, the first and second inner walls being opposite one another and generally parallel to one another and both inner walls extending from the first end of the first solid ink feed channel to the second end of the first solid ink feed channel, the first solid ink feed channel having a longitudinal feed direction from the first end of the first solid ink feed channel to the second end of the first solid ink feed channel and a lateral dimension between the first and the second inner walls through which solid ink is moved from the first end of the first solid ink feed channel to the second end of the first solid ink feed channel to deliver the solid ink to the melt plate for melting, and the keyed opening being configured to enable solid ink of only one predetermined color to be inserted into the first solid ink feed channel;

a driving electrode mounted along a substantial length of the first inner wall of the first solid ink feed channel to position the driving electrode proximate to solid ink within the lateral dimension between the first inner wall and the second inner wall of the first solid ink feed channel as the solid ink moves along the longitudinal feed direction of the first solid ink feed channel;

a sensing electrode mounted along a substantial length of the second inner wall of the first solid ink feed channel to position the sensing electrode proximate to solid ink within the lateral dimension between the first inner wall and the second inner wall of the first solid ink feed channel as the solid ink moves along the longitudinal feed direction of the first solid ink feed channel to enable air and solid ink within the first solid ink feed channel to form a dielectric for a single capacitor between the driving electrode and the sensing electrode;

an AC source switch;

an AC voltage source coupled to the AC source switch, the AC source switch being configured to couple the AC voltage source selectively to the driving electrode to generate an electrical field from the driving electrode only while the AC voltage source is coupled to the driving electrode by the AC source switch; and a capacitance measurement circuit coupled to the sensing electrode to receive an electrical signal induced in the sensing electrode by the electrical field generated by the driving electrode, the capacitance measurement circuit being configured to identify an amount of solid ink in the first feed channel that corresponds to the electrical signal received from the sensing electrode.

2. The solid ink measurement system of claim 1, the driving electrode and the sensing electrode being cylindrical electrical conductors.

3. The solid ink measurement system of claim 1, the driving electrode and the sensing electrode being planar electrical conductors.

4. The solid ink measurement system of claim 1, the driving electrode and the sensing electrode being electrically conductive grids.

5. The solid ink measurement system of claim 1, the AC voltage source providing a direct current (DC) component with an AC voltage.

6. The solid ink measurement system of claim 1 further comprising:

a second solid ink feed channel having a keyed opening at a first end of the second solid ink feed channel, a melt plate at a second end of the second solid ink feed channel, a first inner wall, and a second inner wall, the second inner wall of the second solid ink feed channel being a surface of a structure that is opposite a surface of the structure that forms the second inner wall of the first solid ink channel, the first and second inner walls of the second solid ink feed channel being opposite one another and generally parallel to one another and both inner walls of the second solid ink feed channel extending from the first end of the second solid ink feed channel to the second end of the second solid ink feed channel, the second solid ink feed channel having a longitudinal feed direction from the first end of the second solid ink feed channel to the second end of the second solid ink feed channel and a lateral dimension between the first and the second inner walls of the second solid ink feed channel through which solid ink is moved from the first end of the second solid ink feed channel to the second end of the second solid ink feed channel to deliver solid ink to the melt plate at the second end of the second solid ink feed channel for melting;

a second driving electrode mounted along a substantial length of the first inner wall of the second solid ink feed channel to position the second driving electrode proximate the solid ink within the lateral dimension between the first inner wall and the second inner wall of the second solid ink feed channel as the solid ink moves along the longitudinal feed direction of the second solid ink feed channel;

the sensing electrode being mounted in the structure that forms the second inner wall of the first feed channel and the second inner wall of the second solid ink feed channel to position the sensing electrode proximate to solid ink within the lateral dimension between the first inner wall and the second inner wall of the second solid ink feed channel as the solid ink moves along the longitudinal feed direction of the second solid ink feed channel to enable air and solid ink within the second solid ink feed channel to form a dielectric for a single capacitor between the second driving electrode and the sensing electrode; and the AC source switch is configured to couple the AC voltage source to the driving electrode and the second driving electrode at different times to enable the driving electrode and the second driving electrode to emit an electrical field at the different times and to enable the sensing electrode to provide a first electrical signal to the capacitance measurement circuit to identify a solid ink amount in the first solid ink feed channel in response to the AC source switch coupling the AC voltage source to the first driving electrode and to provide a second electrical signal to the capacitance measurement circuit to identify a solid ink amount in the second solid ink feed channel in response to the AC source switch coupling the AC voltage source to the second driving electrode.

7. The system of claim 6, further comprising:

a third driving electrode mounted along a substantial length of an inner wall of a third solid ink feed channel to position the third driving electrode proximate to solid ink moving through the third solid ink feed channel;

a second sensing electrode being in a structure that forms an inner wall of the third feed channel and an inner wall of a fourth feed channel to position the second sensing electrode proximate to solid ink moving through the third solid ink feed channel to enable air and solid ink in the third solid ink feed channel to form a dielectric for a single capacitor between the third driving electrode and the second sensing electrode; and the AC source switch being configured to selectively couple the driving electrode, the second driving electrode, and the third driving electrode to the AC voltage source to enable the sensing electrode to provide a first electrical signal from the first sensing electrode to the capacitance measurement circuit to identify a solid ink amount in the first solid ink feed channel and a second electrical signal from the second sensing electrode to the capacitance measurement circuit to identify a solid ink amount in the third solid ink feed channel in response to the AC source switch coupling the AC voltage source to the driving electrode and the third driving electrode simultaneously, and to provide a third electrical signal from the first sensing electrode to the capacitance measurement circuit to identify a solid ink amount in the second solid ink feed channel and a fourth electrical signal from the second sensing electrode to the capacitance measurement circuit to identify a solid ink amount in the fourth solid ink feed channel in response to the AC source switch coupling the AC voltage source to the second driving electrode.

8. An ink loader for a solid ink printer comprising:

a plurality of solid ink feed channels through which solid ink is delivered to a plurality of melt plates, each solid ink feed channel having a keyed opening at a first end of each solid ink feed channel, a melt plate at a second end of each solid ink feed channel, a first inner wall, and a second inner wall, the first and second inner walls being opposite one another and generally parallel to one another and both inner walls of each solid ink feed channel extending from the first end of each solid ink feed channel to the second end of each solid ink feed channel, each solid ink feed channel having a longitudinal feed direction from the first end of each solid ink feed channel to the second end of each solid ink feed channel and a lateral dimension between the first and the second inner walls of each solid ink feed channel through which solid ink is moved from the first end of each solid ink feed channel to the second end of each solid ink feed channel to deliver solid ink to each melt plate in the plurality of melt plates for melting, each keyed opening at the first end of each solid ink feed channel being configured to enable only one color of solid ink to be inserted into each solid ink feed channel and the color of solid ink that can inserted through the keyed opening of each solid ink feed channel is different than the color of solid ink that can be inserted through the keyed openings of the other solid ink feed channels in the plurality of solid ink feed channels;

a plurality of driving electrodes arranged in the plurality of solid ink feed channels, at least one of the driving electrodes being mounted to the first inner wall of at least one solid ink feed channel to position the at least one driving electrode proximate to solid ink moving through the at least one solid ink feed channel;

a plurality of sensing electrodes arranged in the plurality of solid ink feed channels, at least one of the sensing electrodes being mounted to the second inner wall of the at least one feed channel to position the at least one sensing electrode proximate to the solid ink moving in the longitudinal feed direction through the at least one solid ink feed channel;

an alternating current (AC) voltage source;

an AC source switch coupled to the AC voltage source and configured to selectively couple the AC voltage source to the driving electrodes to emit an electric field from the driving electrodes at different times into air and solid ink forming a dielectric in the feed channels of the plurality of feed channels; and a capacitance measurement circuit coupled to the plurality of sensing electrodes to receive electrical signals induced in the sensing electrodes by the electric fields generated by the driving electrodes at different times, the capacitance measurement circuit being configured to identify an amount of solid ink in the solid ink feed channels that correspond to the electrical signals received from the sensing electrodes with reference to a capacitance of a single capacitor formed in each feed channel by the driving electrode and the sensing electrode associated with the inner walls of each feed channel and the solid ink and air between the driving electrode and the sensing electrode associated with the inner walls of each feed channel.

9. The ink loader of claim 8, the sensing electrodes being located in structure forming one of the inner walls in each solid ink feed channel of a pair of adjacent solid ink feed channels.

10. The ink loader of claim 9, the driving electrodes being located in structure forming one of the inner walls in each solid ink feed channel of another pair of adjacent solid ink feed channels;

a first driving electrode being located in an outside wall of a first feed channel; and a last driving electrode being located in an outside wall of a last feed channel.

11. The ink loader of claim 8, the driving electrodes and the sensing electrodes being located in structures forming the inner walls of adjacent solid ink feed channels and the driving electrodes and the sensing electrodes being alternated in the structures forming the inner walls of adjacent solid ink feed channels in a left to right sequence across the feed channels.

12. The ink loader of claim 8, wherein the first inner walls of the solid ink feed channels are floors in the solid ink feed channels; and the second inner walls of the solid ink feed channels are located in a cover over the solid ink feed channels.

13. The ink loader of claim 8 wherein the AC source switch selectively couples the AC voltage source to a pair of driving electrodes to emit electric fields towards a sensing electrode shared by the pair of driving electrodes, the driving electrodes in the pair of driving electrodes being coupled to the AC voltage source at mutually exclusive times to generate two electrical signals with the shared sensing electrode, one electrical signal corresponding to an amount of solid ink in one solid ink feed channel and the other electrical signal corresponding to an amount of solid ink in the other solid ink feed channel.

14. The ink loader of claim 8, the AC voltage source also providing a direct current (DC) component to the driving electrodes.

15. The ink loader of claim 8, the driving electrodes and sensing electrodes being conductive strips.

* * * * *